United States Patent [19]

Veatch et al.

[11] 4,174,263

[45] Nov. 13, 1979

[54] RECOVERY OF BITUMEN FROM TAR SANDS

[75] Inventors: Franklin Veatch, Cleveland; Harvey E. Alford, Amherst, both of Ohio

[73] Assignee: Standard Oil Company, Cleveland, Ohio

[21] Appl. No.: 919,890

[22] Filed: Jun. 28, 1978

Related U.S. Application Data

[63] Continuation of Ser. No. 528,062, Nov. 29, 1974, abandoned.

[51] Int. Cl.[2] ..... C10G 1/04

[52] U.S. Cl. ..... 208/11 LE

[58] Field of Search ..... 208/11 LE

[56] References Cited

U.S. PATENT DOCUMENTS

| | | | |
|---|---|---|---|
| 3,203,888 | 8/1965 | Butler et al. | 208/11 LE |
| 3,401,110 | 9/1968 | Floyd et al. | 208/11 LE |
| 3,542,666 | 11/1970 | Simpson | 208/11 LE |
| 3,573,195 | 3/1971 | Bowman et al. | 208/11 LE |
| 3,573,196 | 3/1971 | Cymbalisty | 208/11 LE |
| 3,941,679 | 3/1976 | Smith et al. | 208/11 LE |

*Primary Examiner*—Herbert Levine

*Attorney, Agent, or Firm*—Herbert D. Knudsen; Sherman J. Kemmer; Gwenetta Douglas Hill

[57] ABSTRACT

Bitumen is separated from tar sands by contacting the tar sands with a small amount of liquid, heating the liquid treated tar sands to expand the liquid as a vapor thereby reducing the density of the bitumen and separating the bitumen from the remainder of the tar sands on the basis of density.

3 Claims, 4 Drawing Figures

RECOVERY OF BITUMEN FROM TAR SANDS

This is a continuation of application Ser. No. 528,062 filed Nov. 29, 1974 now abandoned.

BACKGROUND OF THE INVENTION

The recovery of bitumen from tar sands is summarized in *Kirk-Othmer, Encyclopedia of Chemical Technology*, John Wiley & Sons, Inc., New York, 1969, Volume 19. Broadly, there are two processes employed in the recovery of bitumen from tar sands. The first process is the hot water process where the bitumen is conditioned and separated by floatation. Unfortunately, certain tar sands cannot be successfully treated by this process.

The second process is the solvent recovery of bitumen from tar sands where massive amounts of the solvent capable of dissolving the bitumen is contacted with the tar sands to dissolve the bitumen and leave the undissolved sand, clay and other minerals. Since the solvent must be recovered, this process is extremely expensive and has not been worked on a commercial scale.

SUMMARY OF THE INVENTION

The invention is in the process of recovering bitumen from tar sands, the improvement comprising (a) contacting the tar sands with a small amount of a liquid that is able to at least partially penetrate the bitumen to form liquid treated tar sands;

(b) vaporizing at least some of the liquid from the liquid-treated tar sands in such a manner that the density of the bitumen is reduced; and (c) separating the bitumen from the remainder of the tar sands on the basis of density. The present invention is able to deal effectively with tar sands that cannot be worked by the known hot water process and can improve the productivity for those tar sands that do work.

The central feature of the invention is the treatment of the tar sands to make them amenable to the further processing. This treatment involves contacting the tar sands with a liquid that is capable of at least partially penetrating the bitumen in the tar sands.

The process of the invention can be used to treat any material that is generally recognized to be tar sands. By the term tar sands, in the present invention, is meant any mineral containing distinct particles of bitumen. Formations of these tar sands have been discovered throughout the world.

Liquids that are capable of penetrating bitumen in tar sands vary widely. Suitably such liquids include hydrocarbons and halogenated hydrocarbon liquids plus a host of other organic solvents that could be used in this process such as sulfur, nitrogen and oxygen contacting hydrocarbons that are known to be solvents for organic materials. Preferred solvents in the present invention are hydrocarbons and halogenated hydrocarbons. The hydrocarbon solvents are normally readily available in the area where tar sands are processed, and the halogenated hydrocarbons have especially effective penetrating power. Hydrocarbons which are 5–10 carbon atoms have been found to be especially effective in view of their boiling point range. Of special interest are the saturated aliphatic hydrocarbons having 5–8 carbon atoms which are namely pentane, hexane, heptane, octane or mixture thereof.

Broadly, one of the essential features of the solvent is that this liquid can be vaporized to reduce the density of the bitumen. Because high temperatures are to be avoided for heat economy, solvents having a boiling point of less than 200° C. are preferred with those solvents having a boiling point of less than 100° C. being especially preferred.

This liquid that is used to treat the tar sands is referred to as a "floater." This floater liquid volatizes and thereby reduces the density of the bitumen which is necessary for subsequent processing. In the process of the invention, this floater at least partially penetrates the bitumen. In the preferred practice of the invention, and for the best results, the floater completely permeates the bitumen in the tar sands.

The treatment of the tar sands with a floater may vary widely. Broadly, the floater should be incorporated into the bitumen of the tar sands as a liquid so that subsequent vaporization would cause the reduced density. Of course, in a commercial operation, conditions would be adjusted to minimize the amount of time and processing costs for this treatment. In our experiments, we have found that amounts of floater of substantially less than 1% by weight of the tar sands is suitable, although as much as 5% or more could be employed without any adverse affect. For preferred results in the invention, we have demonstrated that amounts of floater in the range of 0.01 to 0.1 wt. % are suitable with very desirable results being obtained with 0.04–0.06 wt. % based on the weight of the tar sand.

The addition of the floater is conveniently accomplished during an initial size reduction step. In this step, the tar sand is crushed for further processing. This size reduction step is normally achieved by using a rod or ball mill or in a laboratory, a Sigma blade mixer, a ribbon mixer or other similar device. The floater liquid in this step is contacted with the tar sands and mixed.

The contact time to accomplish suitable penetration of the floater into the bitumen depends on a large number of processing variables, and the nature of the floater. Floaters having greater penetrating power, of course, require less time than floaters having a less penetrating power. Normally, however, suitable penetration is obtained within a period of 48 hours, with times of just a few minutes being suitable for most floaters having significant penetrating power.

The temperature of the treatment of the tar sands with the floater may vary widely, but it may be below the boiling point of the floater liquid. This assures that the floater is combined with the bitumen as a liquid. If the floater liquid permits, it has been found that temperatures of 30°–60° C. give very desirable results because the bitumen softens within this temperature range. With a softened bitumen, it is believed that permeation of the floater into the bitumen is enhanced.

To assist the floater in the penetration of the bitumen, it may be desirable to add a small amount of a surface active agent. This surface active agent should improve the penetration of the floater into the bitumen without any significant adverse affect. Only extremely small amounts of a surface active agent would be required; for example, amounts considerably less than 0.01 wt. % of the tar sands should give desirable results.

The other process variables for combining the floater with the tar sands are not critical. The pressure may vary widely, but normally, atmospheric pressure is employed.

The above discussion relates to the central feature of the invention which is the combination of the floater with the tar sand. The second step can be practiced in a manner similar to a hot water process. In this step, the floater in the liquid treated tar sand is at least partially vaporized in such a manner that the density of the bitumen is reduced. This step can be accomplished by heating, pressure reduction or some other suitable technique. This step of the process may be conducted in an aqueous medium or it could be conducted without a liquid medium. For example, it is contemplated that the floater-treated tar sands could be conveyed on a moving belt through a heating zone to vaporize the floater. Alternatively, this could take place during a conditioning step described below.

In the vaporization step, the floater liquid is vaporized to produce a closed cell foam of the bitumen. To most effectively accomplish this result, the bitumen should be in a state such that the maximum production of closed cells are caused by the vaporization. Normally, this requires that the bitumen be at least partially fluid so that the gas generated can be trapped. Such fluidity is most conveniently accomplished by heating the tar sands above its softening point. It is also preferred that the production of the closed cell foam in this step take place subsequent to the agglomeration of the bitumen in the tar sands by a step such as conditioning as described below.

The third step of the invention is the separation of the bitumen from the remainder of the tar sands based on density. Although this could be conducted in the absence of a liquid medium, it is very much preferred to use a liquid medium where the bitumen is floated to the top of the liquid and the remainder of the tar sands settles to the bottom. During this step, it is possible to add more heat to assure that the floater is vaporized within the bitumen, thereby assuring the greatest density reduction. For energy conservation purposes, the temperatures employed in this step should be as low as possible.

The preferred liquid medium is water. The amount of water used in the floatation step is not critical, but normally, at least 80% of the mixture by weight should be the aqueous phase; however, larger volumes of water are not detrimental. The contact time in this floatation should be long enough to assure that the bitumen is separated from the remainder of the tar sands. In a laboratory reaction, this time is normally less than an hour.

During the floatation in an aqueous medium, mild agitation may be provided to assure that the bitumen is separated from the remainder of the tar sands. In certain instances, it may also be desirable to provide this agitation by means of blowing a gas through the liquid to assist the separation. This floatation process could be conducted on a batch or a continuous basis.

It has been found that most tar sands require a conditioning step. This conditioning step gathers or agglomerates the bitumen spread throughout the tar sands. This step can take place before, during or after treatment with the floater. It is preferred to conduct this step after the treatment with the floater. Best results are obtained by using an aqueous alkaline solution wherein the pH of the aqueous medium is maintained within the range of about 7.5 to about 10.5 with an alkaline material such as sodium hydroxide, sodium carbonate, sodium silicate, potassium hydroxide, magnesium oxide, calcium oxide and the like. This alkali media assists in separating the bitumen from the remaining minerals. When conditioning is conducted separately in an aqueous medium, normally about 10–100% by weight of water is added to the tar sands with amounts of less than 50% normally being employed. The conditioning is carried out preferably at a temperature above the softening point of the bitumen which is typically about 50° C. Preferably, temperatures in the range of 10°–80° C. above the softening point are employed. Care should be taken using these temperatures because it is important to assure that the floater incorporated into the bitumen is not lost in substantial amounts due to vaporization external to the bitumen. The conditioning should be conducted in a suitable mixing device such as a ribbon mixer, Sigma blade mixer, ball mill or the like. The conditioning normally takes less than two hours on a laboratory scale with normal conditioning times of about 5–10 minutes being used in a small laboratory batch.

The above discussion relates each one of the steps of the process individually. In commercial practice, it is most likely that two or more of these steps would be combined into one treatment procedure. Some of the possible combinations are shown in the drawings. Also, it is certainly possible to incorporate the steps described above into a procedure that calls for additional steps, but as long as the floater addition, vaporization and separation are present, the present invention applies.

It is believed that in most instances, the process steps described above would be sufficient to separate essentially all of the bitumen from the tar sands. Accordingly, there would be no need for additional processing of the tar sands as is currently practiced with the hot water process. The remainder of the tar sands other than the bitumen may be discarded, and the bitumen may be moved directly to further processing or use.

The process of the invention provides an economically feasible method for recovering bitumen from tar sands. It provides great assurance that the bitumen can be neatly separated from the tar sands, and it also would eliminate the need for processing of the spent tar sands after the initial floatation. The process is substantially superior to the solvent process wherein large volumes of solvents are employed because the small volumes of solvent employed as the floater in the present invention can be discarded without significant economic loss.

DESCRIPTION OF THE DRAWING

FIG. 1 shows treatment according to the basic individual steps of the invention.

FIG. 2 shows the treatment according to the basic steps of the invention, including a conditioning step by the floater addition and vaporization.

FIG. 3 shows a modification where the process is reduced to two steps—a floater addition and a separate conditioning, vaporization and separation.

FIG. 4 shows a two-step process where floater addition and conditioning take place in the first step and vaporization and separation take place in the second step.

SPECIFIC EMBODIMENTS

Comparative Example A and Examples 1–2

Figure 1:
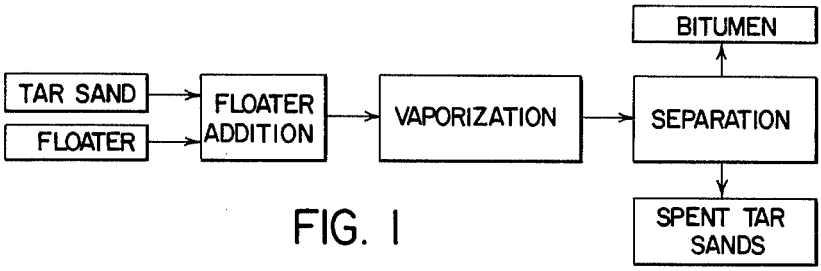
FIGS. 1–4 show various schemes of treating the tar sands according to the invention.
Figure 2:
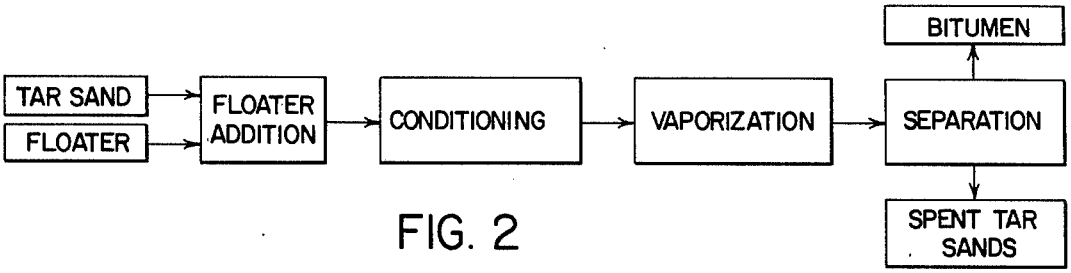
Figure 3:
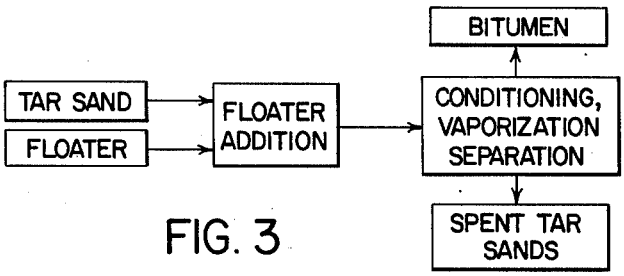
Figure 4:
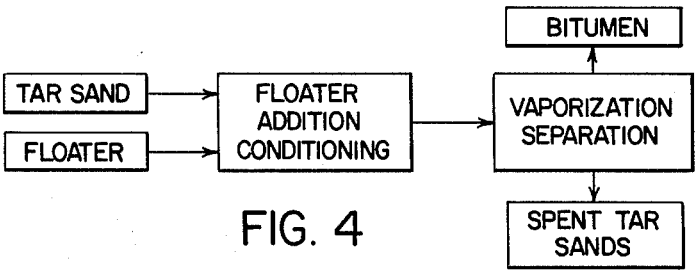

Reovery of bitumen from tar sands with various floater liquids

In essentially parallel experiments, the recovery of bitumen from tar sands using various floater liquids were compared to the use of no floater liquid. In the experiments, 125 g. samples of County Pit tar sand from Asphalt Ridge, Utah, were taken and contacted with various floater liquids in a closed vessel for a number of hours to allow the floater liquid to completely penetrate the bitumen in the tar sand. The floater-liquid treated tar sand was then mixed with 10 ml. 10% NaOH and 25 ml. of $H_2O$ at room temperature for five minutes. 100 milliliters of boiling water was added to give a resulting temperature of 88° C. The results of these experiments are given below.

Table 1

Recovery of Bitumen from Asphalt Ridge Utah Tar Sands (125 g. Samples)

| Example | Amount | Boiling Point °C. | % Bitumen Floated | Remarks |
|---|---|---|---|---|
| Comp. A | None | — | <5 | Essentially none of the bitumen |
| 1 | 0.5 g. petroleum ether | 30-60 | 90 | Considerable flotation |
| 2 | 0.5 g. chloroform | 61 | >95 | Essentially complete floatation |

Examples 3-5

Recovery of bitumen from different tar sands

In the same manner as shown above, the bitumen was recovered from various tar sands in the Asphalt Ridge deposits. In Example 3, tar sands from the Duchesne River Formation were employed. In Example 4 deposits from the Rim Rock Bed Formation were employed and in Example 5 deposits from the County Pit were employed. The results of these tests are shown in Table 2. The procedure followed was exactly the same as that for the above examples except rather than using boiling water, water having a temperature of about 60° C. was added to the tar sands and heat was applied until the bitumen floated. In all experiments, chloroform having a boiling point of 61° C., was employed as the floater. In each of the experiments, 0.1 g. of chloroform was added to the 125 g. tar sands.

Table 2

Recovery of Bitumen from Asphalt Ridge Utah Tar Sands (125 g. Samples)

| Example | Tar Sand Foundation | Maximum Temp. °C. | % Bitumen Floated | Remarks |
|---|---|---|---|---|
| 3 | Duchesne River Foundation | 69 | >95 | Sand appeared completely clean |
| 4 | Rim Rock Bed Foundation | 72 | 90 | Small amount of bitumen on Tar Sand. Work better with crushed |
| 5 | County Pit | 63 | >95 | Sand clean |

We claim:

1. In a process for the recovery of bitumen from tar sands wherein bitumen is separated from the remainder of the tar sands by a floatation technique, the improvement comprising the steps of:
   (a) contacting the tar sands with from 0.01 to 0.1 weight percent based on the weight of the tar sands of a liquid halogenated hydrocarbon that is able to at least partially penetrate the bitumen to form liquid treated tar sands;
   (b) vaporizing at least some of the liquid halogenated hydrocarbon treated tar sands to produce a closed cell foam of the bitumen, whereby the vapor in the bitumen is entrapped, thereby reducing the density of the bitumen; and
   (c) separating the bitumen from the remainder of the tar sands by floatation whereby there is employed the step of mixing the liquid halogenated hydrocarbon treated tar sands with an aqueous alkaline solution to condition the tar sands prior to said floatation step.

2. The process of claim 1 wherein the steps (a) and (c) are conducted simultaneously.

3. The process of claim 1 wherein the liquid halogenated hydrocarbon is chloroform.

* * * * *